US010245702B2

(12) United States Patent
McIntyre

(10) Patent No.: US 10,245,702 B2
(45) Date of Patent: Apr. 2, 2019

(54) CONTROL OF WET ABRASIVE BLASTERS

(71) Applicant: Graco Minnesota Inc., Minneapolis, MN (US)

(72) Inventor: John McIntyre, Dunnville (CA)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 15/524,510

(22) PCT Filed: Nov. 2, 2015

(86) PCT No.: PCT/US2015/058611
§ 371 (c)(1),
(2) Date: May 4, 2017

(87) PCT Pub. No.: WO2016/073352
PCT Pub. Date: May 12, 2016

(65) Prior Publication Data
US 2018/0021923 A1 Jan. 25, 2018

Related U.S. Application Data

(60) Provisional application No. 62/076,054, filed on Nov. 6, 2014.

(51) Int. Cl.
*B24C 7/00* (2006.01)
*F04B 49/22* (2006.01)

(52) U.S. Cl.
CPC ..... *B24C 7/0038* (2013.01); *B24C 7/0023* (2013.01); *F04B 49/225* (2013.01)

(58) Field of Classification Search
CPC ..... B24C 7/00; B24C 7/0038; B24C 7/0023
(Continued)

(56) References Cited

U.S. PATENT DOCUMENTS 5,201,150 A 4/1993 Kuboyama et al.
5,230,185 A * 7/1993 Kirschner ..... B24C 7/0053 451/38

(Continued)

FOREIGN PATENT DOCUMENTS

DE 202005009318 U1 8/2005
EP 0122928 B1 1/1989

(Continued)

OTHER PUBLICATIONS

International Preliminary Report on Patentability for PCT application No. PCT/US2015/058611, dated May 9, 2017, 8 pages.

(Continued)

*Primary Examiner* — Robert Rose
(74) *Attorney, Agent, or Firm* — Kinney & Lange, P.A.

(57) ABSTRACT

An incoming water control for use in a wet abrasive blasting system includes an incoming water supply with a pressure of between 1 psi and 200 psi, a pressure reducing valve for reducing the pressure of the incoming water supply, and an air over water pneumatic piston style water pump that incorporates check valves. The pump receives water having a water pressure of less than 20 psi from the pressure reducing valve and the pump delivers water to a blast pot pressure vessel of the wet abrasive blasting system to pressurize the blast pot pressure vessel filled with water and abrasive.

8 Claims, 2 Drawing Sheets

(58) Field of Classification Search
USPC ..... 451/38, 39, 40, 75, 90, 99, 101
See application file for complete search history.

(56) References Cited

U.S. PATENT DOCUMENTS

| | | | | |
|---|---|---|---|---|
| 5,407,379 | A * | 4/1995 | Shank | B24C 7/0053 451/101 |
| 5,484,325 | A | 1/1996 | Shank | |
| 6,224,463 | B1 | 5/2001 | Hartzell, Jr. | |
| 2012/0015592 | A1* | 1/2012 | Eliason | B24C 7/0038 451/91 |

FOREIGN PATENT DOCUMENTS

| | | | |
|---|---|---|---|
| EP | 0514945 | A1 | 11/1992 |
| EP | 1450988 | B1 | 10/2005 |
| GB | 902668 | | 8/1962 |
| WO | WO9522432 | A1 | 8/1995 |
| WO | WO0051787 | A1 | 9/2000 |

OTHER PUBLICATIONS

Extended European Search Report for European Patent Application No. 15857462.4, dated Apr. 26, 2018, 7 pages.
International Search Report and Written Opinion for Application Serial No. PCT/US2015/058611, dated Jan. 29, 2016, 12 Pages.

* cited by examiner

PRIOR ART

CONTROL OF WET ABRASIVE BLASTERS

BACKGROUND

Wet abrasive blasting systems are typically used in situations requiring blasting operations that do not tolerate dry sand blasting conditions due to environmental or other factors. Wet abrasive blasting systems are used to control generation of dust and at the same time ensure that there is minimal damage to the substrate. Wet abrasive blasting systems use a method to force the slurry of abrasive media into a compressed air stream under controlled conditions. A blast pot or pressure vessel is charged with water from an exterior water supply together with a solid abrasive to form a water abrasive slurry. Once the blast pot is closed and purged of all air, it is fed with pressurized water normally from a water pump, and this pressurized water forces the slurry out of the blast pot, into a piping system, and finally into the mixing point where the wet slurry is mixed with compressed air. Fluctuations in the water supply to the wet abrasive blasting equipment cause instability in the entire system and provide for inconsistent behaviour of the wet abrasive blasting system, which ultimately can lead to an uncontrollable or inefficient blasting process. It has been found that the water supply can vary in pressure from 1 psi to over 200 psi depending upon the water supply source. In practice wide fluctuations in the pressure of the water supply cannot be tolerated by the wet abrasive blasting systems and therefore it is not possible to use some sources of water supply.

SUMMARY

An incoming water control for use in a wet abrasive blasting system includes an incoming water supply with a pressure of between 1 psi and 200 psi, a pressure reducing valve for reducing the pressure of the incoming water supply, and an air over water pneumatic piston style water pump that incorporates check (or one-way flow) valves. The pump receives water having a water pressure of less than 20 psi from the pressure reducing valve and the pump delivers water to a blast pot pressure vessel of the wet abrasive blasting system to pressurize the blast pot pressure vessel filled with water and abrasive.

DETAILED DESCRIPTION

Figure 1:
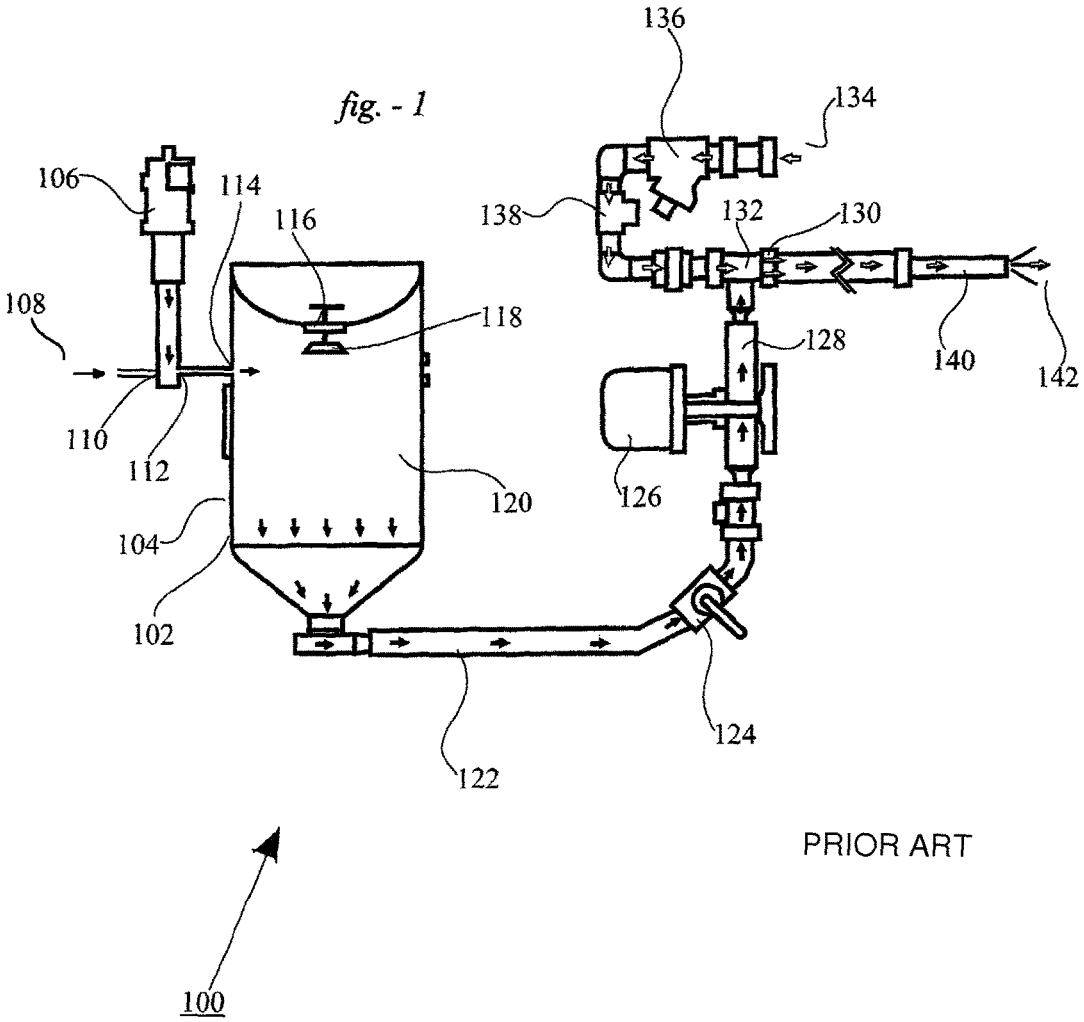
FIG. 1 is a schematic of a prior art wet abrasive blasting system.

FIG. 1 is a prior art depiction of a typically used wet abrasive blasting system shown generally as 100. System 100 includes the following major components, namely blast pot 102 (which includes pressure vessel 104), blast pot water inlet 114, fill inlet 116, pop up valve 118. Pressure vessel 104 is filled with water abrasive mixture 120.

Blast pot 102 is normally fed with pressurized water from water pump 106, which receives water from an exterior water supply 108. Water pump 106 includes pump water inlet 110 and pump water outlet 112. Water abrasive mixture 120 flows from pressure vessel 104 through transfer hose 122, ball valve 124, and a pinch hose 128, which is controlled by pinch valve 126, to mixing point 132 at T connector 130. Air supply 134 delivers compressed air, which enters through air valve 136 and check valve 138. The compressed air mixes with the water abrasive mixture 120 at mixing point 132 to form an air water abrasive blast mixture 142, which flows out through blast nozzle 140.

In practice, water supply 108 normally is a static water holding tank which supplies water to pump water inlet 110 under gravity feed. The pressure supplied by water supply 108 (a static water holding tank) will simply be the static head of the water above pump water inlet 110, which normally is somewhere between 1 to 10 psi. Water pump 106 is a pneumatic air over water pump which uses a piston to drive a water piston pump on the lower end to increase the pressure from the pump water inlet 110 to the pump water outlet 112.

The type of water pump 106 normally employed includes inlet and outlet check valves (or one-way flow valves) which open and close depending upon the stroke of the piston within the cylinder of water pump 106. The pressure created by the downward stroke of piston water pump 106 closes the inlet check valve and therefore closes off pump water inlet 110 in order to pressurize the water within water pump 106 and forcibly pump water out of water outlet 112.

Difficulties arise when the water supply 108 pressure increases beyond 20 psi because now water pump 106 requires an increased amount of pressure to close the inlet check valve at pump water inlet 110. Once the water supply 108 inlet pressure is overcome by water pump 106, the inlet check valve will often slam shut violently causing a pressure spike to travel through the entire system including through blast pot 102, transfer hose 122, pinch hose 128, and ultimately out through blast nozzle 140. These pressure spikes make it difficult to control the entire system and can lead to erratic behaviour of wet abrasive blasting system 100.

In order to avoid these problems, other suppliers of wet abrasive systems 100 use a static holding water tank which is fed by an exterior supply. The exterior water supply may be city water, pumped water or other sources of water under more than 20 psi of pressure. The use of a static holding tank can be cumbersome and also lead to further issues in regard to the control of the water level within the static tank, requiring level control shut off valves for the incoming water supply.

It would be beneficial to be able to have a system that can run off of any water supply such as city water and/or off a pressurized water line. Incoming water supply pressures range anywhere from 1 psi to 200 psi depending upon the source—whether it be a static water head, whether it be city water or whether it be an external independent water pumping system.

Figure 2:
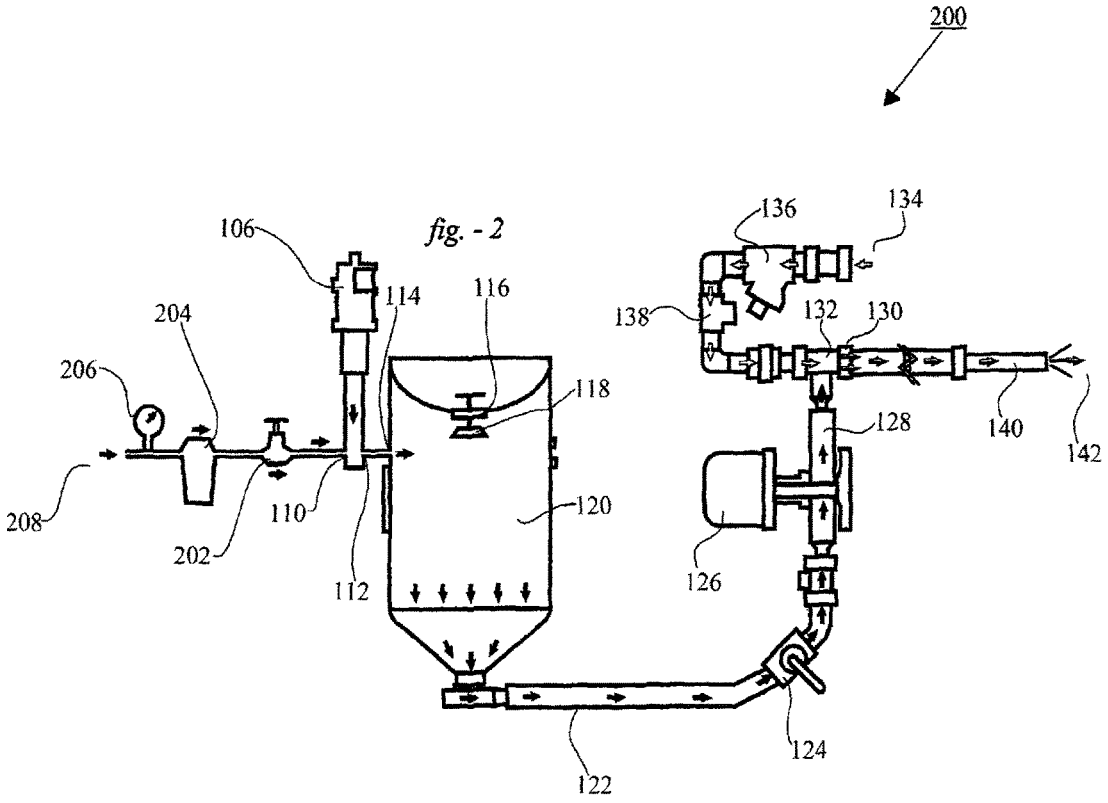
FIG. 2 is a schematic of a currently developed wet abrasive blasting system.

FIG. 2 shows wet abrasive blasting system 200, which includes all of the components previously shown in FIG. 1 in addition to the following components: namely, pressure reducing valve 202, water filter 204, pressure gauge 206, and incoming water supply 208.

Water abrasive blasting system 200 can accept any water supply 208 at incoming pressure between 0 and 200 psi and be able to regulate and maintain this water pressure to below 20 psi (and preferably between 10 and 15 psi). This regulation of water pressure provides smooth operation of water pump 106, and prevents inlet check (or one-way flow) valve slamming and the resulting pressure spikes.

Water supply 208 may be any water supply including a static head. It may be city water at approximately 50 to 80 psi, or it may be an independent water pump which may deliver water with pressure as high as 200 psi. Water supply

208 flows past pressure gauge 206 and water filter 204, and then through a pressure reducing valve 202 in order to reduce the incoming pressure to below 20 psi (and preferably to somewhere between 10 to 15 psi) regardless of the water supply pressure 208 in order to provide smooth operation of the water pump.

When the incoming pressure seen at water pump 106 is below 20 psi (and preferably between 10 to 15 psi), it has been found through experiment that the valving in water pump 106 operates smoothly and no longer causes pressure spiking throughout the system due to the slamming shut of the ball valves in water pump 106.

Water pump 106 preferably is a low pressure transfer pump, which is a pneumatic overwater piston style water pump which includes inlet and outlet ball valves. In order for the ball valves to operate smoothly and not create pressure spiking and/or slamming of ball valves, it is important that the pressure seen at the pump water inlet 110 be less than 20 psi (and preferably between 10 and 15 psi).

Pressure reducing valve 202 preferably be water pressure valve, which is a diaphragm style pressure reducing valve able to handle water pressures between 0 and 200 psi and reduce the outgoing water pressure to below 20 psi, and preferably between 10 to 15 psi.

By incorporating pressure reducing valve 202 any incoming water supply 208 can be utilized, such as static pressure water head which normally runs between 1 and 10 psi, a city water supply which normally runs between 50 and 80 psi, and/or an independent water pump water supply which can run as high as 200 psi. In this manner, the incoming water pressure seen at pump water inlet 110 can be reduced to below 20 psi (and preferably controlled between 10 and 15 psi) to ensure smooth operation of water pump 106 and the elimination of water spikes due to slamming of inlet and outlet valves within water pump 106.

Although the present invention has been described with reference to preferred embodiments, workers skilled in the art will recognize that changes may be made in form and detail without departing from the spirit and scope of the invention.

I claim:

1. An incoming water control for use in a wet abrasive blasting system that includes a blast pot pressure vessel for containing water and abrasive, a hose that connects an outlet of the blast pot pressure vessel to a mixing point at which water abrasive mixture is mixed with compressed air, and a blast nozzle from which an air water abrasive mixture is delivered, the water control comprising:

an incoming water supply that delivers water with a pressure of between 1 psi and 200 psi through a water supply line;

a pressure reducing valve disposed on the water supply line and configured to regulate and maintain the pressure of water from the incoming water supply below 20 psi; and a water pump connected to the water supply line and disposed downstream of the pressure reducing valve, wherein the water pump includes check valves that receive water having a water pressure of less than 20 psi from the pressure reducing valve and delivers water to the blast pot pressure vessel to pressurize the blast pot pressure vessel filled with water and abrasive.

2. The water control of claim 1, wherein the pressure reducing valve controls water pressure supplied to the pump to between 10 psi and 15 psi.

3. The water control of claim 1, wherein the check valves include an inlet check valve and an outlet check valve.

4. A wet abrasive blasting system comprising:

a blast pot pressure vessel for containing water and abrasive;

an incoming water supply that delivers water with an pressure between 1 psi and 200 psi through a water supply line extending to the blast pot pressure vessel;

a pressure reducing valve disposed on the water supply line and configured to regulate and maintain the pressure of water from the incoming water supply below 20 psi;

a water pump connected to the water supply line and disposed downstream of the pressure reducing valve, wherein the water pump includes check valves and receives water having a water pressure of less than 20 psi from the pressure reducing valve and delivers water to the blast pot pressure vessel to pressurize the blast pot pressure vessel;

a mixing point disposed downstream of the blast pot pressure vessel at which a water abrasive mixture from the blast pot pressure vessel is mixed with compressed air; and a blast nozzle from which an air water abrasive mixture produced by the mixing chamber is delivered.

5. The system of claim 4, wherein the pressure reducing valve controls water pressure supplied to the pump to between 10 psi and 15 psi.

6. The system of claim 4, wherein the check valves include an inlet check valve and an outlet check valve.

7. The water control of claim 1, wherein the water pump comprises an air overwater pneumatic piston style water pump.

8. The system of claim 4, wherein the water pump comprises an air overwater pneumatic piston style water pump.

* * * * *